US008708317B2

(12) United States Patent
Lee

(10) Patent No.: US 8,708,317 B2
(45) Date of Patent: Apr. 29, 2014

(54) VENTURI TUBE FOR SHOWER HEAD

(75) Inventor: Chun-Hsin Lee, Changhua (TW)

(73) Assignee: Chyi Liou Enterprise Co., Ltd., Changhua (TW)

( * ) Notice: Subject to any disclaimer, the term of this patent is extended or adjusted under 35 U.S.C. 154(b) by 318 days.

(21) Appl. No.: 13/343,699

(22) Filed: Jan. 4, 2012

(65) Prior Publication Data

US 2013/0168879 A1 Jul. 4, 2013

(51) Int. Cl.
*B01F 3/04* (2006.01)

(52) U.S. Cl.
USPC ..... 261/75; 261/118; 261/DIG. 75

(58) Field of Classification Search
USPC ..... 261/76, 118, DIG. 75; 137/895
See application file for complete search history.

(56) References Cited

U.S. PATENT DOCUMENTS 8,459,304 B2 * 6/2013 Cheng et al. ..... 137/895

* cited by examiner

*Primary Examiner* — Robert A Hopkins

(57) ABSTRACT

A Venturi tube device is provided with a Venturi tube; a hollow cylindrical fitting; a shroud; and a hollow, cylindrical flow guide member disposed in the Venturi tube. In a showing operation, air can flow through one communicating hole of the shroud, a space defined by two adjacent ridges on the fitting, a conic hole between the two adjacent ridges, and a transverse hole of the Venturi tube in addition to water flowing through the flow guide member and the Venturi tube.

1 Claim, 7 Drawing Sheets

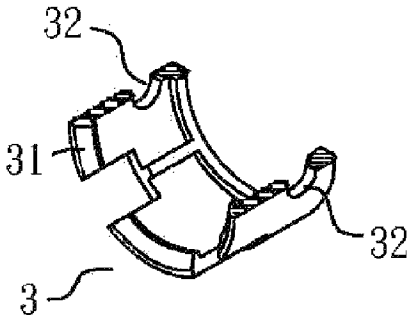
FIG. 1B
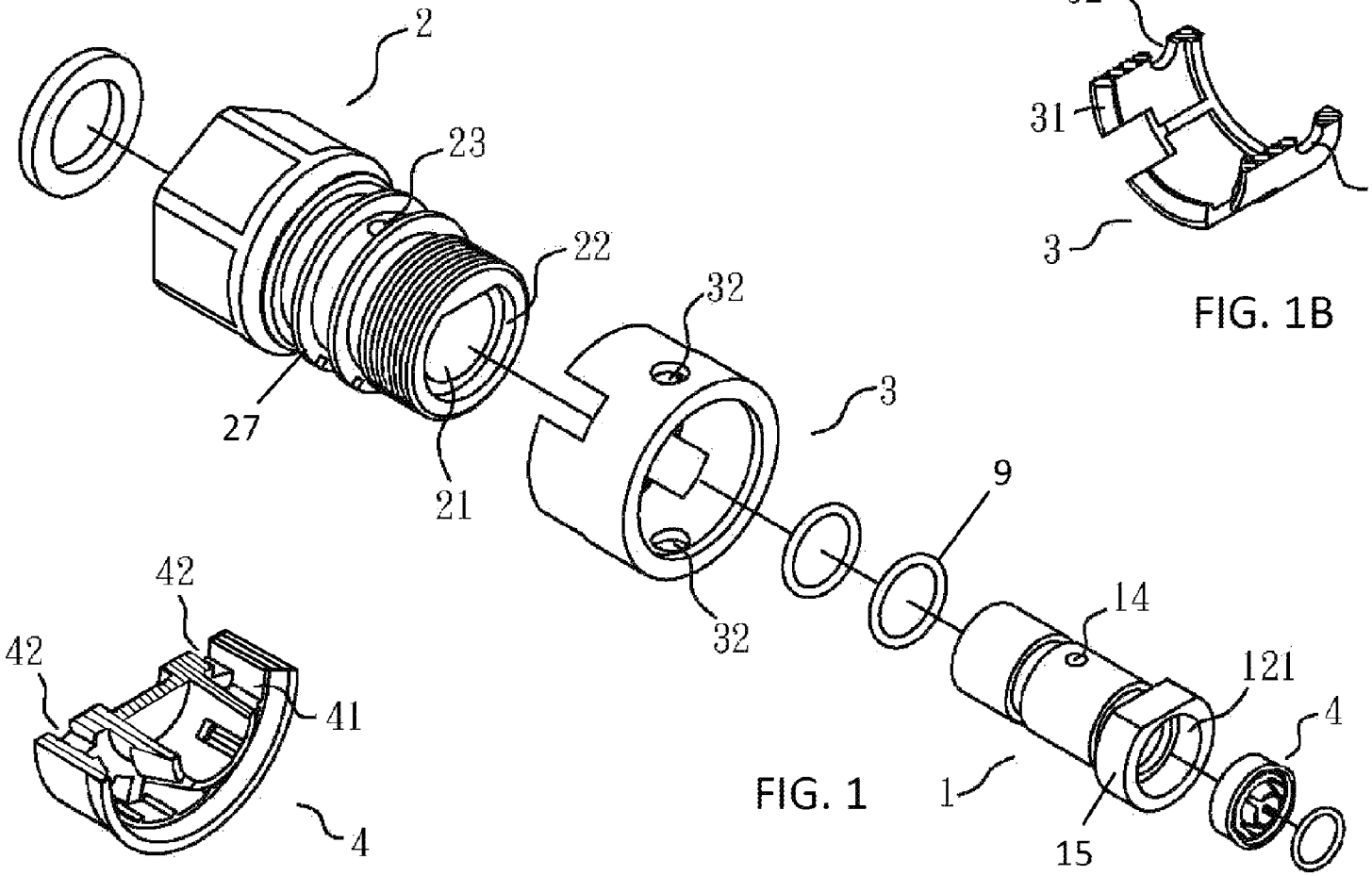
FIG. 1
FIG. 1A

VENTURI TUBE FOR SHOWER HEAD

BACKGROUND OF THE INVENTION

1. Field of the Invention

The invention relates to shower heads and more particularly to a Venturi tube device mounted with a shower head.

2. Description of Related Art

It is typical that water approaching a shower head may flow slower due to friction loss of the flow. Thus, a weak spray pattern is formed by dispersing a stream of water by the shower head.

Venturi effect is a jet effect. In a pipe the velocity of the fluid increases as the cross sectional area decreases while the static pressure correspondingly decreasing. According to the laws governing fluid dynamics, a fluid's velocity must increase as it passes through a constriction of the pipe to satisfy the principle of continuity, while its pressure must decrease to satisfy the principle of conservation of mechanical energy. Thus any gain in kinetic energy a fluid may accrue due to its increased velocity through a constriction is negated by a drop in pressure. An equation for the drop in pressure due to the Venturi effect may be derived from a combination of Bernoulli's principle and the continuity equation.

The invention discussed below aims to incorporate a Venturi tube into a shower head attachment for increasing the fluid's velocity.

SUMMARY OF THE INVENTION

It is therefore one object of the invention to provide a Venturi tube device comprising a Venturi tube comprising an axial forward channel, an axial rear channel including a circular recess, an intermediate constriction cone communicating with both the forward and rear channels, the constriction cone having a forward portion with a cross sectional area less than that of a rear portion thereof, a transverse hole having one end communicating with the forward channel and the other end being open, and a rear D-shaped flange with the circular recess; a hollow cylindrical fitting comprising an axial tunnel, a rear D-shaped recess having a diameter greater than that of the tunnel, an externally threaded extension with the D-shaped recess contained therein, a forward internally threaded extension having a diameter greater than that of the tunnel, a shoulder interconnecting the tunnel and the internally threaded extension, a plurality of annular ridges formed on an outer surface of the fitting between the externally threaded extension and the internally threaded extension, and a conic hole disposed between two adjacent ones of the ridges to have one end communicating with the tunnel and the other end being open wherein the Venturi tube is fastened in the fitting with the flange complimentarily anchored in the D-shaped recess to align the transverse hole with the conic hole and dispose the transverse hole in close proximity to the conic hole; a shroud comprising two opposite communicating holes through an outer surface, each communicating hole having a diameter greater than a lengthwise distance between two adjacent ones of the ridges, and a plurality of equally spaced front latches wherein the shroud is mounted on the ridges by securing the latches thereto so that one communicating hole is spaced apart and aligned with the conic hole with air being capable of flowing through one communicating hole, a space defined by two adjacent ones of the ridges, the conic hole, and the transverse hole; and a hollow, cylindrical flow guide member disposed in the circular recess and comprising a rear annular cavity and a plurality of equally spaced front openings communicating with the cavity.

The above and other objects, features and advantages of the invention will become apparent from the following detailed description taken with the accompanying drawings.

BRIEF DESCRIPTION OF THE DRAWINGS

FIG. 1 is an exploded view of a Venturi tube device for shower head according to the invention;

FIG. 1A is a cross-sectional view of the flow guide member;

FIG. 1B is a cross-sectional view of the shroud;

DETAILED DESCRIPTION OF THE INVENTION

Figure 2:
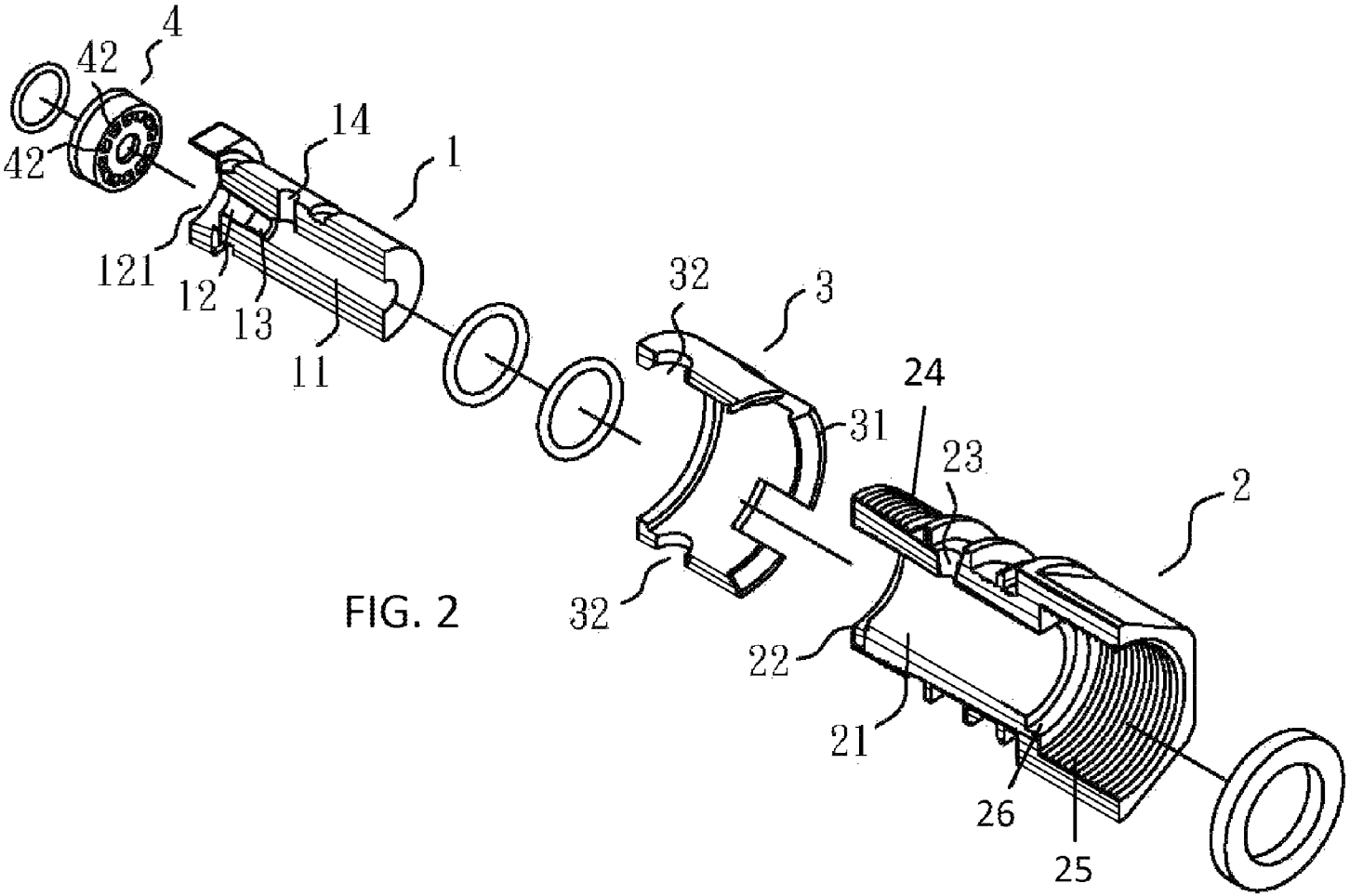
FIG. 2 is a longitudinal sectional view of the Venturi tube, the shroud, and the fitting of FIG. 1.
Figure 3:
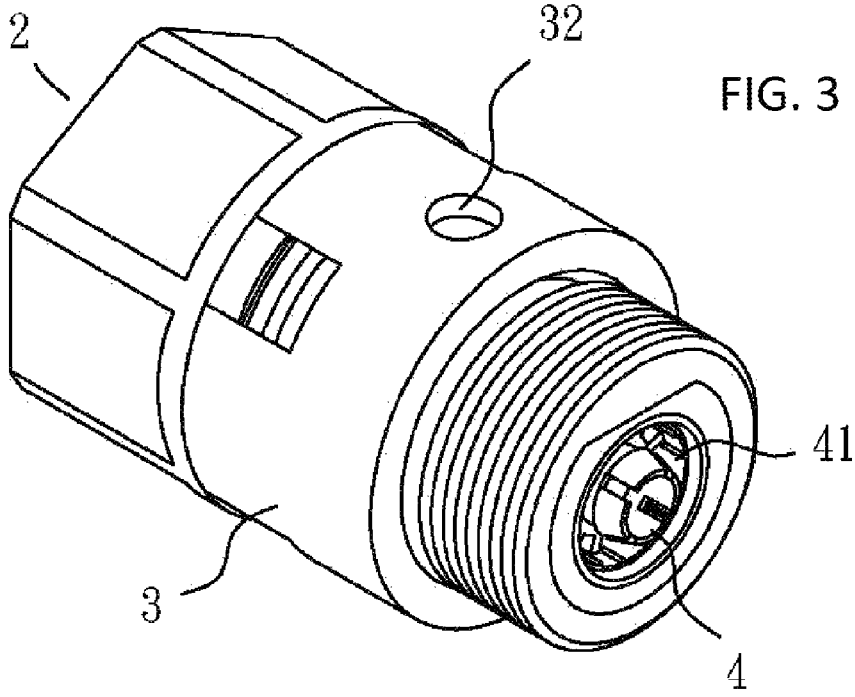
FIG. 3 is a perspective view of the assembled Venturi tube device.
Figure 4:
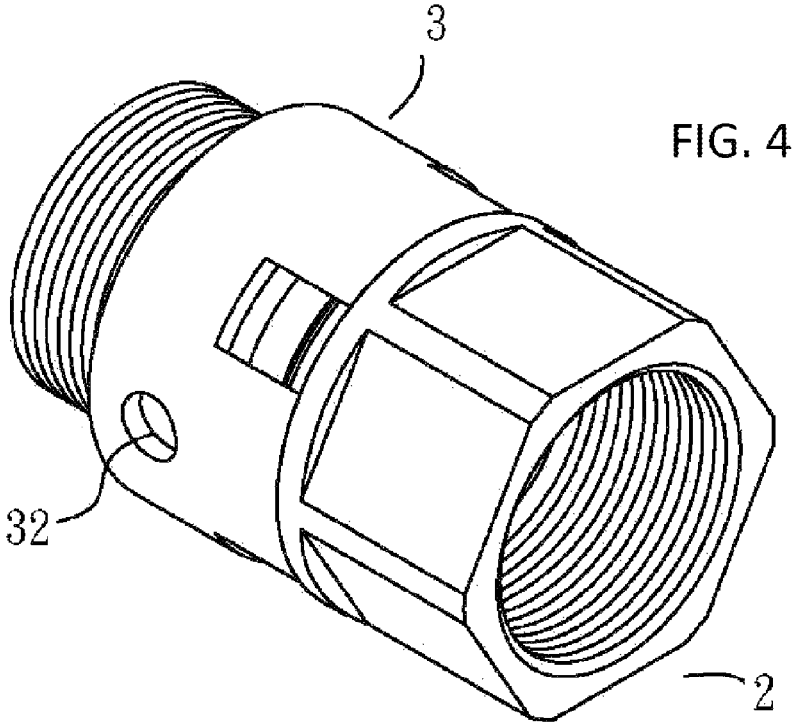
FIG. 4 is another perspective view of FIG. 3 but viewing from an opposite angle.
Figure 5:
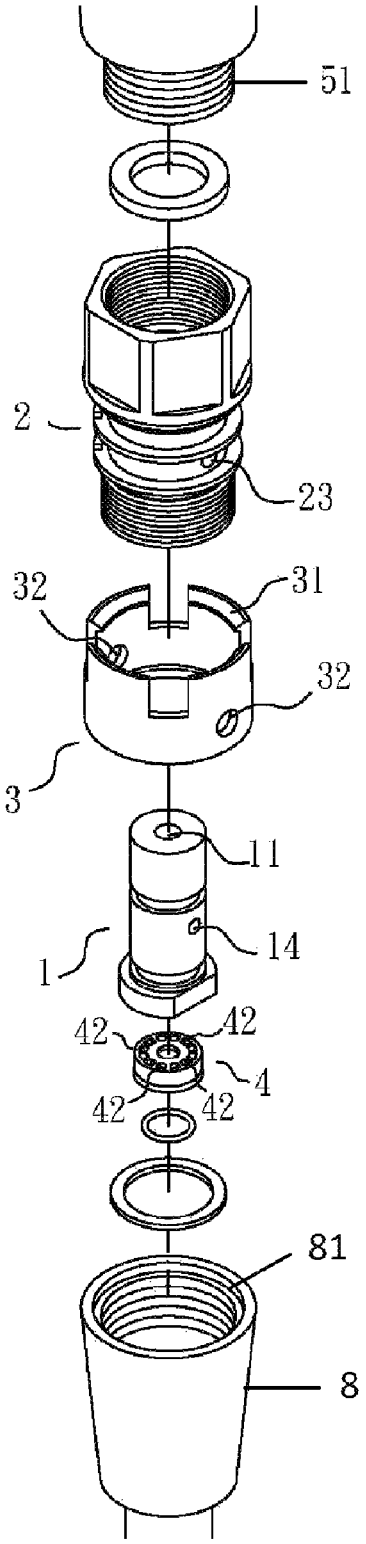
FIG. 5 is an exploded view of the Venturi tube device to be assembled with a shower head according to a first preferred embodiment of the invention.
Figure 5A:
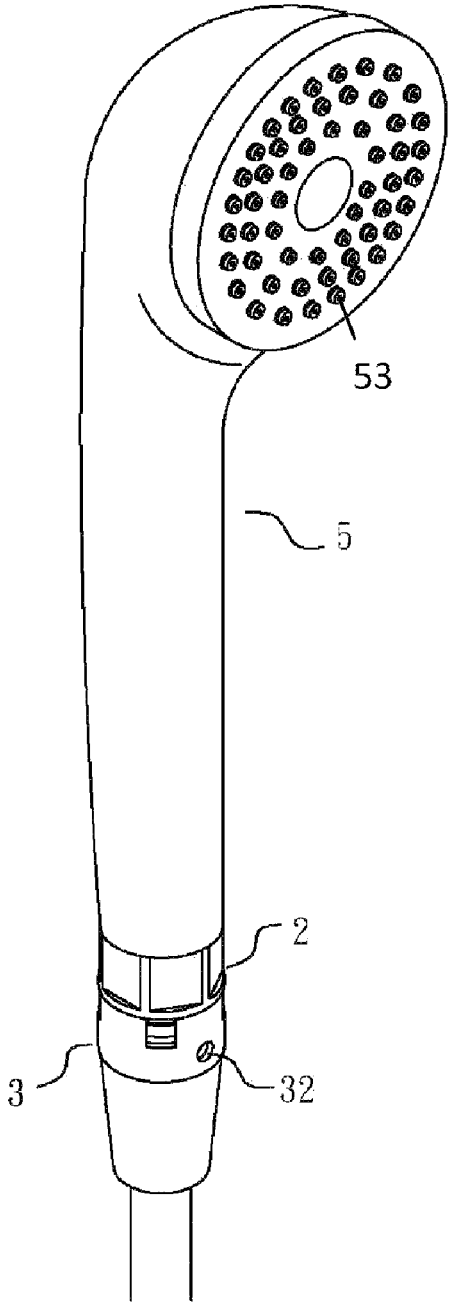
FIG. 5A is a perspective view of the assembled Venturi tube device and the shower head of FIG. 5.

Referring to FIGS. 1 to 10, a Venturi tube device accordance with the invention is shown and comprises the following components discussed in detail below.

A Venturi tube 1 comprises an axial forward channel 11, an axial rear channel 12 including a rear, shallow, circular recess 121, an intermediate constriction cone 13 communicating with both the channels 11, 12, the constriction cone 13 having a forward portion with a cross sectional area less than that of a rear portion thereof, a transverse hole 14 having one end communicating with the forward channel 11 and the other end being open, and a rear D-shaped flange 15 with the recess 121 contained therein. The Venturi tube 1 thus has an uneven inner diameter.

A hollow cylindrical fitting 2 comprises an axial tunnel 21, a rear, shallow, D-shaped recess 22 having a diameter greater than that of the tunnel 21, an externally threaded extension 24 with the D-shaped recess 22 contained therein, a forward internally threaded extension 25, a shoulder 26 interconnecting the tunnel 21 and the internally threaded extension 25, a plurality of (e.g., three) annular ridges 27 formed on an outer surface of the fitting 2 between the externally threaded extension 24 and the internally threaded extension 25, and a conic hole 23 through one of the three valleys between two adjacent ridges 27 to have one end communicating with the tunnel 21 and the other end being open. The internally threaded extension 25 has a diameter greater than that of the tunnel 21. That is, the fitting 2 has a stepped-diameter axial channel.

A shroud 3 comprises four equally spaced latches 31 on a front end, and two opposite communicating holes 32 through the surface, each communicating hole 32 having a diameter greater than a lengthwise distance between two adjacent ridges 27. A shallow, hollow, cylindrical flow guide member 4 comprises an annular cavity 41 on a rear end, and a plurality of openings 42 equally spaced around a front end, the openings 42 communicating with the cavity 41.

In a first preferred embodiment, in an assembled state the Venturi tube 1 is fastened in the fitting 2 with the flange 15 complimentarily anchored in the D-shaped recess 22 to ensure that the conic hole 23 is aligned with and almost contacts the transverse hole 14. And in turn, the externally threaded extension 24 is secured to internal threads 81 of a coupling 8 at one end of a tube for supplying water to a shower head 5. The shroud 3 is mounted on the ridges 27 by securing the latches 31 thereto in which one of the communicating holes 32 is spaced apart and aligned with the conic hole 23 so that a fluid (e.g., air) channel can be formed by the communicating hole 32, the space defined by two adjacent ridges 27, the conic hole 23, and the transverse hole 14. The flow guide member 4 is complimentarily anchored in the recess 121. Further, the internally threaded extension 25 is secured to an externally threaded extension 51 at one end of a shower head 5. A plurality of sealing rings (e.g., O-rings and gaskets) 9 are put on the Venturi tube 1, a joining portion of the shroud 3, the fitting, and the Venturi tube 1, and a joining portion of the Venturi tube 1, the fitting 2, and an end of the shower head 5 respectively for sealing purposes. As a result, the Venturi tube device for shower head is formed.

Figure 7:
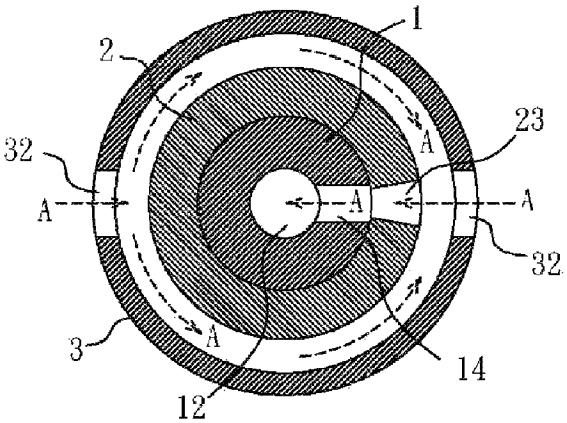
FIG. 7 is a sectional view taken along lines A-A of FIG. 6.
Figure 7A:
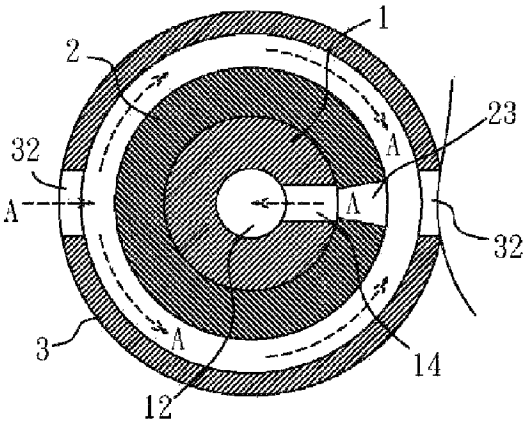
FIG. 7A is a view similar to FIG. 7 showing one of the two holes being blocked.
Figure 6:
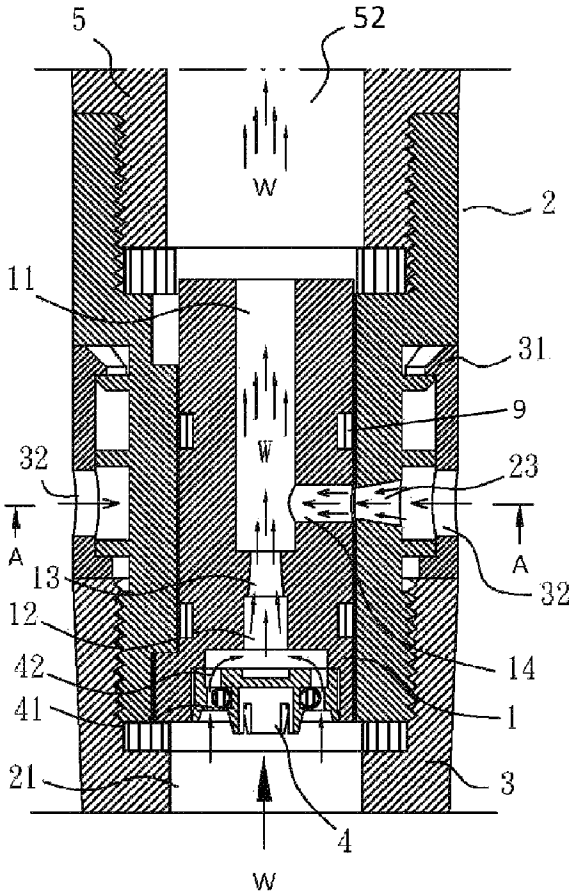
FIG. 6 is a longitudinal sectional view of the Venturi tube device and adjacent portions of the shower head of FIG. 5.

As shown in FIGS. 6 and 7, water W (indicated by arrows) may flow from the pipe through the cavity 41, the openings 42, the rear channel 12, the constriction cone 13, and the forward channel 11 to a channel 52 of the shower head 5. According to Venturi effect, velocity of the flow W increases when it leaves the constriction cone 13 due to decreased cross sectional area. Further, atmospheric pressure is higher than the internal pressure of the forward channel 11. Thus, air A (indicated by arrows) is quickly sucked into the forward channel 11 through the air channel formed by the communicating hole 32, the space defined by two adjacent ridges 27, the conic hole 23, and the transverse hole 14. The sucking action can further increase the velocity of the flow W. As a result, flow W entering the nozzles 53 of the shower head 5 is pressurized so as to disperse a stream of water to form a strong spray pattern. Advantageously, above Venturi effect cannot be compromised even when one of the two communicating holes 32 is blocked (see FIG. 7A).

Figure 8:
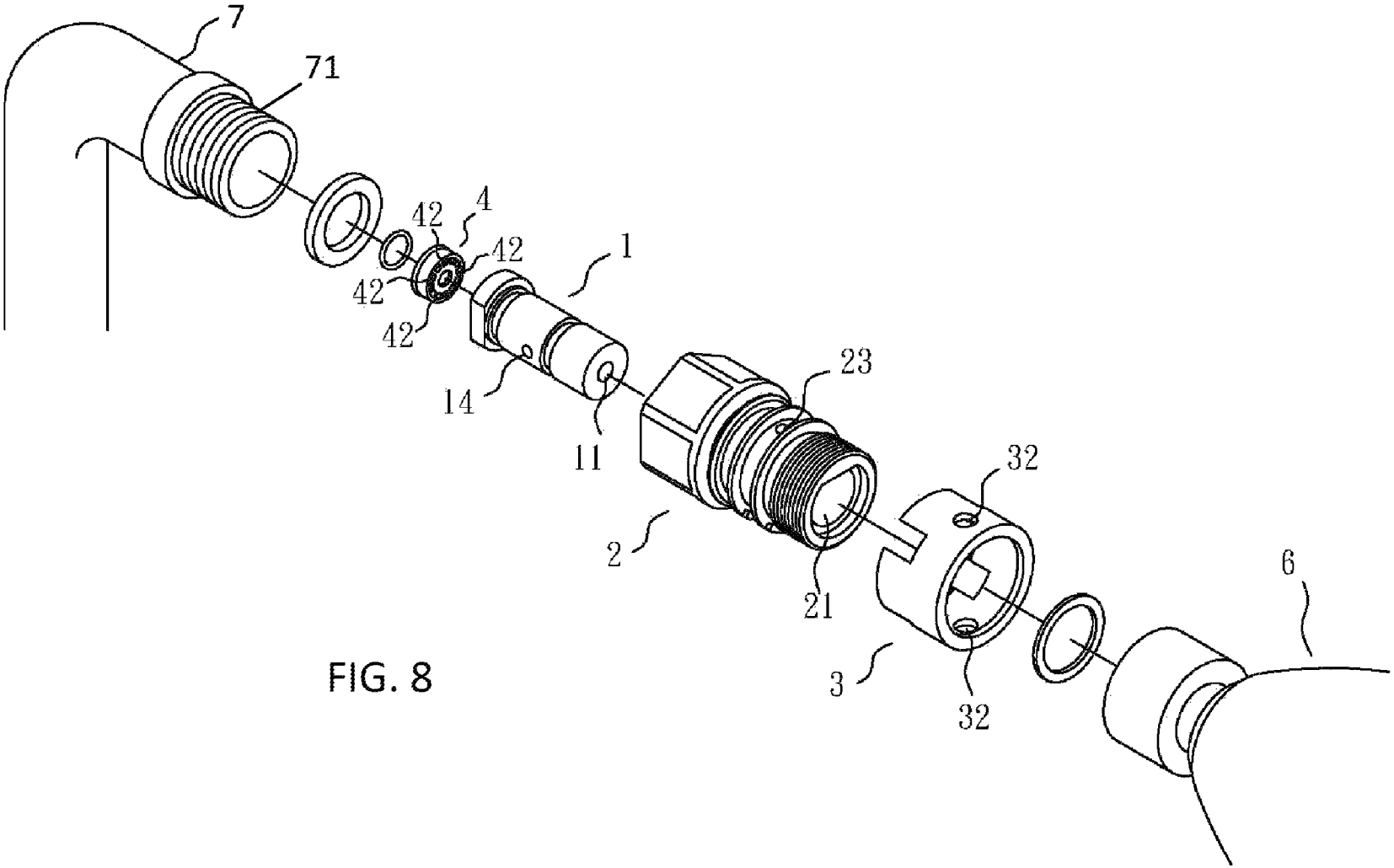
FIG. 8 is an exploded view showing the Venturi tube device, another type of shower head, and a bent pipe to be assembled according to a second preferred embodiment of the invention.
Figure 9:
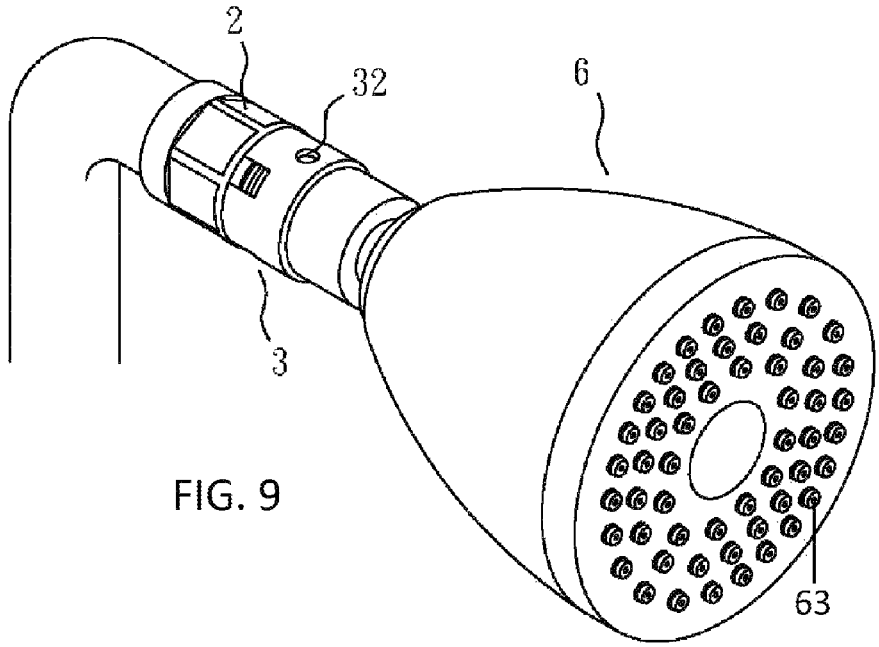
FIG. 9 is a perspective view of the assembled Venturi tube device, another type of shower head, and the bent pipe of FIG. 8.
Figure 10:
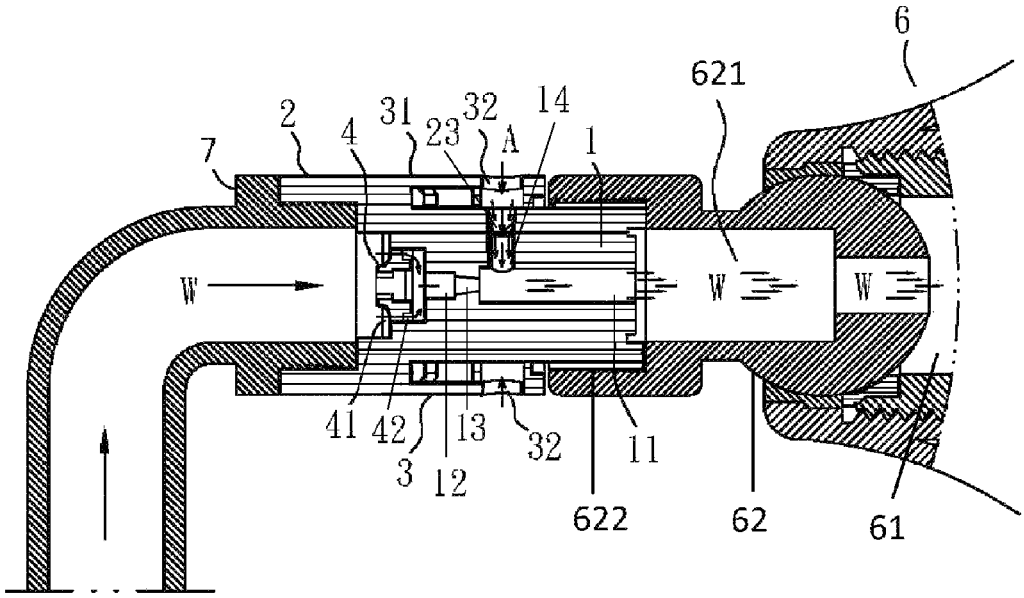
FIG. 10 is a longitudinal sectional view of FIG. 9.

As shown in FIGS. 8, 9 and 10 in conjunction with FIGS. 1 and 2, a second preferred embodiment of the invention is shown. A shower head 6 comprises a plurality of nozzles 63, an axial channel 61 for flowing water, and a rear hollow universal joint 62 formed at the end of the channel 61 distal nozzles 63, the universal joint 62 including an axial channel 621 and rear internal threads 622. In an assembled state, the internal threads 622 are secured to the externally threaded extension 24 to fasten the shower head 6 and the fitting 2 together. Further, the externally threaded extension 25 is secured to an externally threaded extension 71 at one end of a bent pipe 7. As a result, the Venturi tube device for shower head is formed. Water W (indicated by arrows) may flow from the pipe 7 through the cavity 41, the openings 42, the rear channel 12, the constriction cone 13, the forward channel 11, and the channel 621 to the channel 61 of the shower head 6. According to Venturi effect, velocity of the flow W increases when it leaves the constriction cone 13 due to decreased cross sectional area. Further, atmospheric pressure is higher than the internal pressure of the forward channel 11. Thus, air A (indicated by arrows) is quickly sucked into the forward channel 11 through the air channel formed by the communicating hole 32, the space defined by two adjacent ridges 27, the conic hole 23, and the transverse hole 14. The sucking action can further increase the velocity of the flow W. As a result, flow W entering the nozzles 63 of the shower head 6 is pressurized so as to disperse a stream of water to form a strong spray pattern. Advantageously, above Venturi effect cannot be compromised even when one of the two communicating holes 32 is blocked.

While the invention has been described in terms of preferred embodiments, those skilled in the art will recognize that the invention can be practiced with modifications within the spirit and scope of the appended claims.

What is claimed is:

1. A Venturi tube device comprising:

a Venturi tube comprising an axial forward channel, an axial rear channel including a circular recess, an intermediate constriction cone communicating with both the forward and rear channels, the constriction cone having a forward portion with a cross sectional area less than that of a rear portion thereof, a transverse hole having one end communicating with the forward channel and the other end being open, and a rear D-shaped flange with the circular recess;

a hollow cylindrical fitting comprising an axial tunnel, a rear D-shaped recess having a diameter greater than that of the tunnel, an externally threaded extension with the D-shaped recess contained therein, a forward internally threaded extension having a diameter greater than that of the tunnel, a shoulder interconnecting the tunnel and the internally threaded extension, a plurality of annular ridges formed on an outer surface of the fitting between the externally threaded extension and the internally threaded extension, and a conic hole disposed between two adjacent ones of the ridges to have one end communicating with the tunnel and the other end being open wherein the Venturi tube is fastened in the fitting with the flange complimentarily anchored in the D-shaped recess to align the transverse hole with the conic hole and dispose the transverse hole in close proximity to the conic hole;

a shroud comprising two opposite communicating holes through an outer surface, each communicating hole having a diameter greater than a lengthwise distance between two adjacent ones of the ridges, and a plurality of equally spaced front latches wherein the shroud is mounted on the ridges by securing the latches thereto so that one communicating hole is spaced apart and aligned with the conic hole with air being capable of flowing through one communicating hole, a space defined by two adjacent ones of the ridges, the conic hole, and the transverse hole; and a hollow, cylindrical flow guide member disposed in the circular recess and comprising a rear annular cavity and a plurality of equally spaced front openings communicating with the cavity.

* * * * *